US008079171B2

(12) United States Patent
Barrett

(10) Patent No.: US 8,079,171 B2
(45) Date of Patent: Dec. 20, 2011

(54) ADJUSTABLE RIFLE TELESCOPE SYSTEM WITH MULTIPLE FIXED ANGLE MOUNT SETPOINTS

(76) Inventor: Christopher Gene Barrett, Murfreesboro, TN (US)

( * ) Notice: Subject to any disclaimer, the term of this patent is extended or adjusted under 35 U.S.C. 154(b) by 257 days.

(21) Appl. No.: 12/157,681

(22) Filed: Jun. 11, 2008

(65) Prior Publication Data

US 2009/0307956 A1 Dec. 17, 2009

(51) Int. Cl.
*F41G 1/387* (2006.01)

(52) U.S. Cl. ..... 42/125

(58) Field of Classification Search ..... 42/125, 42/126, 127, 124
See application file for complete search history.

(56) References Cited

U.S. PATENT DOCUMENTS 1,474,209 A * 11/1923 Reynolds ..... 42/126
1,770,451 A * 7/1930 Baker ..... 42/126
2,004,489 A * 6/1935 Kuhn ..... 42/126
2,018,960 A * 10/1935 Kuhn ..... 42/126
2,073,210 A * 3/1937 Horsrud ..... 42/126
2,101,037 A * 12/1937 O'Neil ..... 42/126
2,135,774 A * 11/1938 Tilden ..... 42/126
2,143,167 A * 1/1939 Pechar ..... 42/126
2,208,913 A * 7/1940 Unertl ..... 42/126
4,205,473 A * 6/1980 Wilson ..... 42/127
5,428,915 A * 7/1995 King ..... 42/126
5,433,010 A * 7/1995 Bell ..... 42/126
7,140,143 B1 * 11/2006 Ivey ..... 42/125

* cited by examiner

*Primary Examiner* — Bret Hayes
(74) *Attorney, Agent, or Firm* — Bennet K. Langlotz; Langlotz Patent & Trademark Works, Inc.

(57) ABSTRACT

A rifle telescope has optics having an optical axis, a scope support portion that supports the optics, and a base portion that mounts to a firearm having a barrel axis. The scope support portion has at least two different settings, each setting providing a different angle between the optical axis and the barrel axis. The invention may also include each setting being a discrete fixed setting. The present invention also includes a method for adjusting the angle mount of an adjustable rifle telescope with multiple fixed angle mount setpoints.

20 Claims, 5 Drawing Sheets

ADJUSTABLE RIFLE TELESCOPE SYSTEM WITH MULTIPLE FIXED ANGLE MOUNT SETPOINTS

FIELD OF THE INVENTION

The present invention relates to an adjustable rifle telescope system with multiple fixed angle mount setpoints for use in connection with firearms. The adjustable rifle telescope system with multiple fixed angle mount setpoints has particular utility in connection with enabling accurate long-distance shooting where significant elevation compensation is required.

BACKGROUND OF THE INVENTION

Adjustable rifle telescopes with multiple fixed angle mount setpoints are desirable for enabling accurate long-distance shooting where significant elevation compensation is required. Optical scopes are mounted on rifles to provide a clear magnified image of a target and to provide an adjustable aiming point to indicate the point of impact of a projectile on a target. Scopes typically have an internal optical adjustment to shift the image or apparent location of the crosshairs to compensate for the amount that the bullet drops below the axis of the barrel as it flies over a distance. A similar lateral adjustment is normally provided for windage compensation.

While it is possible in some instances to mount a scope with its optical axis parallel to the barrel bore axis and employ the optical adjustment to compensate for bullet drop, this approach is generally not considered practical. Internal optical adjustments have limited ranges of adjustment, and designs that have greater adjustment range are bulkier than is desirable. Essentially, a scope mounted parallel to the barrel wastes the upper half of the adjustment range of the scope because the bullet will never fly upward, only downward relative to the barrel bore's axis.

Consequently, many scope-mounting systems provide a selected angular deviation that points the scope slightly downward with respect to the barrel bore axis. The angular deviation is typically less than a degree, with a deviation in the range of 10-50 minutes of angle (MOA) being typical. The deviation may be achieved in a rail system to which a scope mount is attached or in a scope mount having rings encompassing a scope tube, with the rear ring at a higher elevation than the front ring. This allows use of a practical scope mechanism that employs the upper range of adjustment for nearer shots and the lower range below a neutral setting for more distant shots where bullet drop is greatest.

While an angled mount is effective for a single selected cartridge having known flight characteristics and for a scope having known adjustment capabilities, a single angled mount is not suitable for a varied range of cartridges or versatile for a range of different scope types. Thus, numerous different-angled mounts must be manufactured and stocked, and users must buy multiple mounts to provide for different applications.

The use of externally adjustable rifle telescopes is known in the prior art. For example, some scope mounting systems provide a means for adjusting a scope externally. Such adjustments are typically made with a micrometer or other elevation screw adjustment at the rear of the scope, with the front pivotally mounted to the rifle. However, these are less robust systems than the present invention and suffer from backlash that can make repeatable settings unreliable.

Therefore, a need exists for a new and improved adjustable rifle telescope system with multiple fixed angle mount setpoints that can be used for enabling accurate long-distance shooting where significant elevation compensation is required. In this regard, the various embodiments of the present invention substantially fulfill at least some of these needs. In this respect, the adjustable rifle telescope system with multiple fixed angle mount setpoints according to the present invention substantially departs from the conventional concepts and designs of the prior art, and in doing so provides an apparatus primarily developed for the purpose of enabling accurate long-distance shooting where significant elevation compensation is required.

SUMMARY OF THE INVENTION

The present invention provides an improved adjustable rifle telescope system with multiple fixed angle mount setpoints, and overcomes the above-mentioned disadvantages and drawbacks of the prior art. As such, the general purpose of the present invention, which will be described subsequently in greater detail, is to provide an improved adjustable rifle telescope system with multiple fixed angle mount setpoints that has all the advantages of the prior art mentioned above.

To attain this, the preferred embodiment of the present invention essentially comprises optics having an optical axis, a scope support portion that supports the optics, and a base portion that mounts to a firearm having a barrel bore axis. The scope support portion has at least two different settings, each setting providing a different angle between the optical axis and the barrel bore axis. The preferred embodiment of the present invention may also comprise each setting being a discrete fixed setting. The present invention also includes a method for adjusting the angle mount of an adjustable rifle telescope system with multiple fixed angle mount setpoints. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
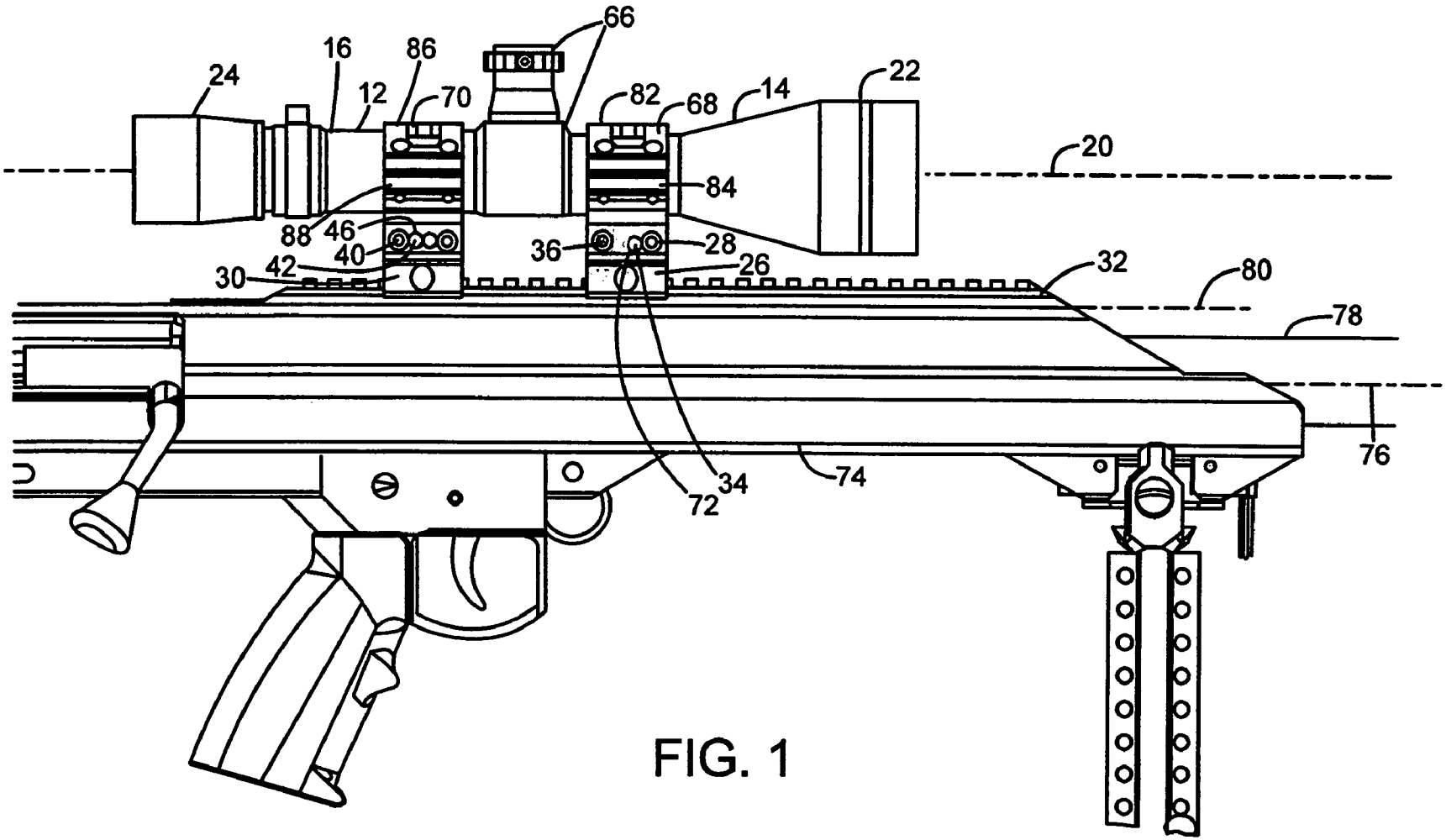
FIG. 1 is a side view of the current embodiment of the adjustable rifle telescope system with multiple fixed angle mount setpoints constructed in accordance with the principles of the present invention.

A preferred embodiment of the adjustable rifle telescope system with multiple fixed angle mount setpoints of the present invention is shown and generally designated by the reference numeral 10.

FIG. 1 illustrates an improved adjustable rifle telescope system with multiple fixed angle mount setpoints 10 of the present invention. More particularly, the adjustable rifle telescope system with multiple fixed angle mount setpoints 10, also known as a riflescope or telescopic rifle sight, is depicted attached to a firearm 74 by a rail 32. The rifle 74 has a barrel 78, which is a hollow metal tube. The barrel 78's interior diameter defines the barrel 78's bore. The center of the barrel 70's bore defines the barrel bore axis 76. The rail axis 80, defined by the centerline of rail 32, is depressed by 20-30 MOA (Minutes of Angle) in typical applications with respect to the barrel bore axis 76. The scope system 10's optical axis 20 is defined by the centers of the front scope rings 68 and rear scope rings 70. Depending upon the position of the rear set pin 42, the optical axis 20 is set at either 15 MOA additional depression or 40 MOA additional depression beyond that already provided by the rail 32. Once the optical axis 20 is set, internal optical adjustments are made using adjustment knobs 66.

Figure 2:
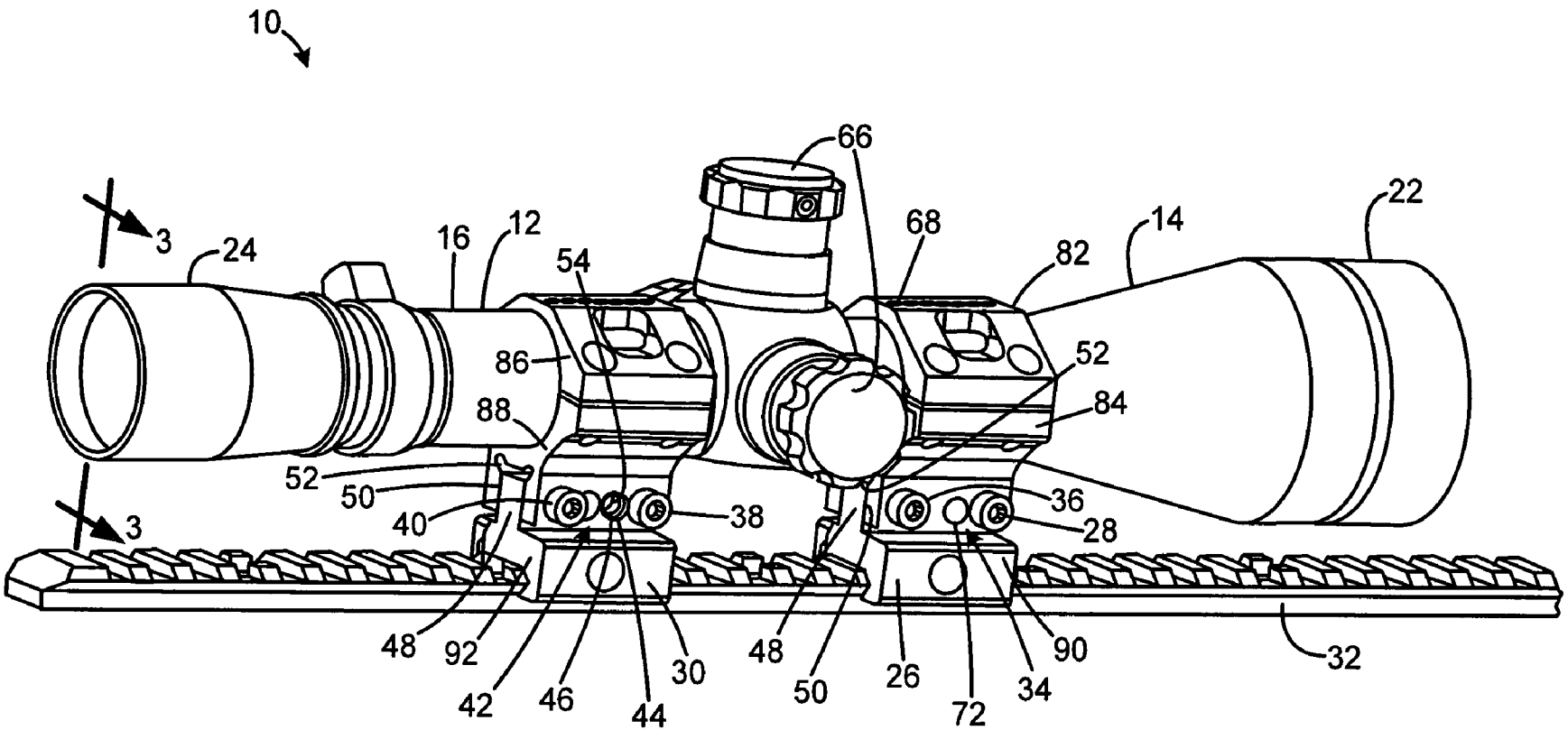
FIG. 2 is a side perspective view of the current embodiment of the adjustable rifle telescope system with multiple fixed angle mount setpoints of the present invention.
Figure 3:
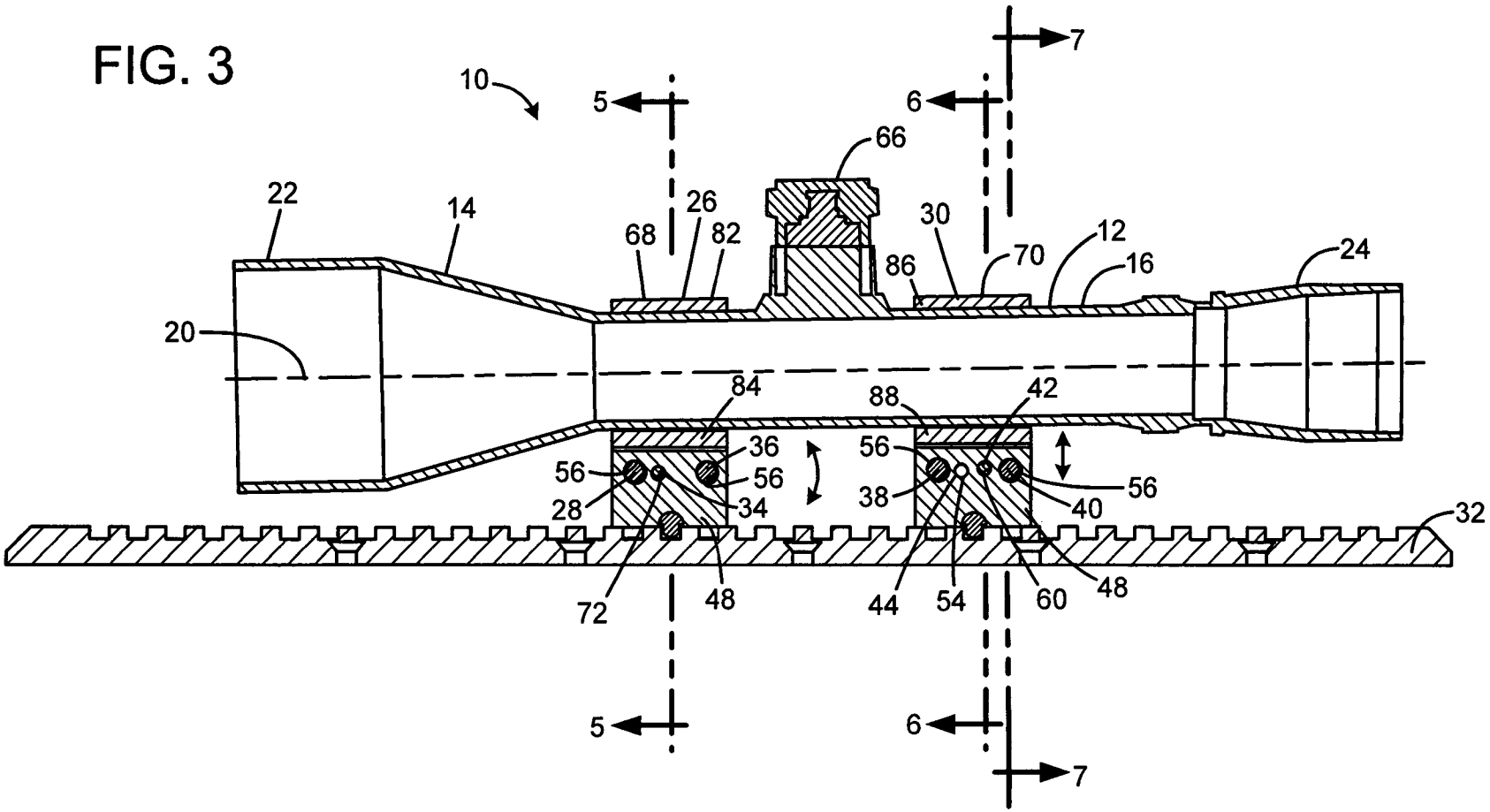
FIG. 3 is a side sectional view of the current embodiment of the adjustable rifle telescope system with multiple fixed angle mount setpoints of the present invention.

FIGS. 2 and 3 illustrate the improved adjustable rifle telescope system with multiple fixed angle mount setpoints 10 of the present invention. More particularly, the adjustable rifle telescope system with multiple fixed angle mount setpoints 10 includes an elongated hollow tube body 12 having a front end 14 and a rear end 16. An objective lens assembly 22 is connected to the front end 14, and an eyepiece 24 is connected to the rear end 16.

The scope system 10 is secured to a rail 32 that is connected to the receiver or frame of a firearm 74 or other projectile emitting device, and front mount 26 and rear mount 30 are rigidly and removably connected to the rail 32. In the current embodiment, rail 32 is a rail system. In alternative embodiments, the firearm 74 may have a receiver that is drilled and tapped for receiving bolt-on scope mounts, or any other conventional means of attaching a scope to a rifle. The orientation of the body 12 and the scope system 10's optical axis 20 are adjustable with respect to the rail 32 and therefore to the barrel bore axis 76 of the firearm 74 as well. The body 12 pivots at the front mount 26 and is adjustable between two fixed vertical positions at the rear mount 30.

The pivotable front mount 26 includes a rail-engaging portion 90, a lower ring portion 84, and an upper ring portion 82. The rail-engaging portion 90 has a tongue 48 that is slidably and snugly inserted into a tongue slot 50 formed by two downwardly depending wings in the lower ring portion 84. When wings are compressed together, the tongue is tightly gripped, and does not move under even substantial recoil impulses. One wing has a threaded insert that is engaged by the threads on the free end of the screw, and the other is compressed by the shoulder of the screw head.

The lower ring portion 84 has a front pivot pin hole 72 that receives a front pivot pin 34. First front mount screw 28 and second front mount screw 36 releasably secure the lower ring portion 84 to the rail-engaging portion 90. The upper ring portion 82 is attached to the lower ring portion 84 by conventional threaded fasteners. When assembled to form front scope ring 68, the upper ring portion 82 and lower ring portion 84 tightly encompass and support the front end 14 of the scope body 12.

The adjustable rear mount 30 is spaced apart rearwardly of the front mount 26 and includes a rail-engaging portion 92, a lower ring portion 88, and an upper ring portion 86. The rail-engaging portion 92 has a tongue 48 that is slidably inserted into a close-fitting tongue slot 50 in the lower ring portion 88. The interface between the ring and the lower portion is the same as the fount mount, with the tongue being securely clamped in place when the selected height is provided.

To establish the selected height of the rear mount (and therefore the desired depression angle) the lower ring portion 88 has two pairs of set pin holes that establish the optical axis 20 setting. The first set pin hole 44 and third set pin hole 54 form the first pair, and second set pin hole 46 and fourth set pin hole 60 form the second pair. One pair of holes aligns with the ring one distance above the rail, and the other set aligns with the ring a different distance above the rail. This provides two precise and different angles for the scope depression.

A rear set pin 42 that closely fits within any of the holes is removably inserted into whichever of the two pairs of set pin holes the user has aligned to fix the scope system 10's optical axis 20 in place. The pins fit so closely into the holes that there is no play in the connection, and a very precise alignment is provided because of the use of a precision-ground pin. First rear mount screw 38 and second rear mount screw 40 releasably secure the lower ring portion 88 to the rail-engaging portion 92. The upper ring portion 86 is threadedly attached to the lower ring portion 88. When assembled to form rear scope ring 70, upper ring portion 86 and lower ring portion 88 encompass and support the rear end 16 of the scope body 12.

Figure 4:
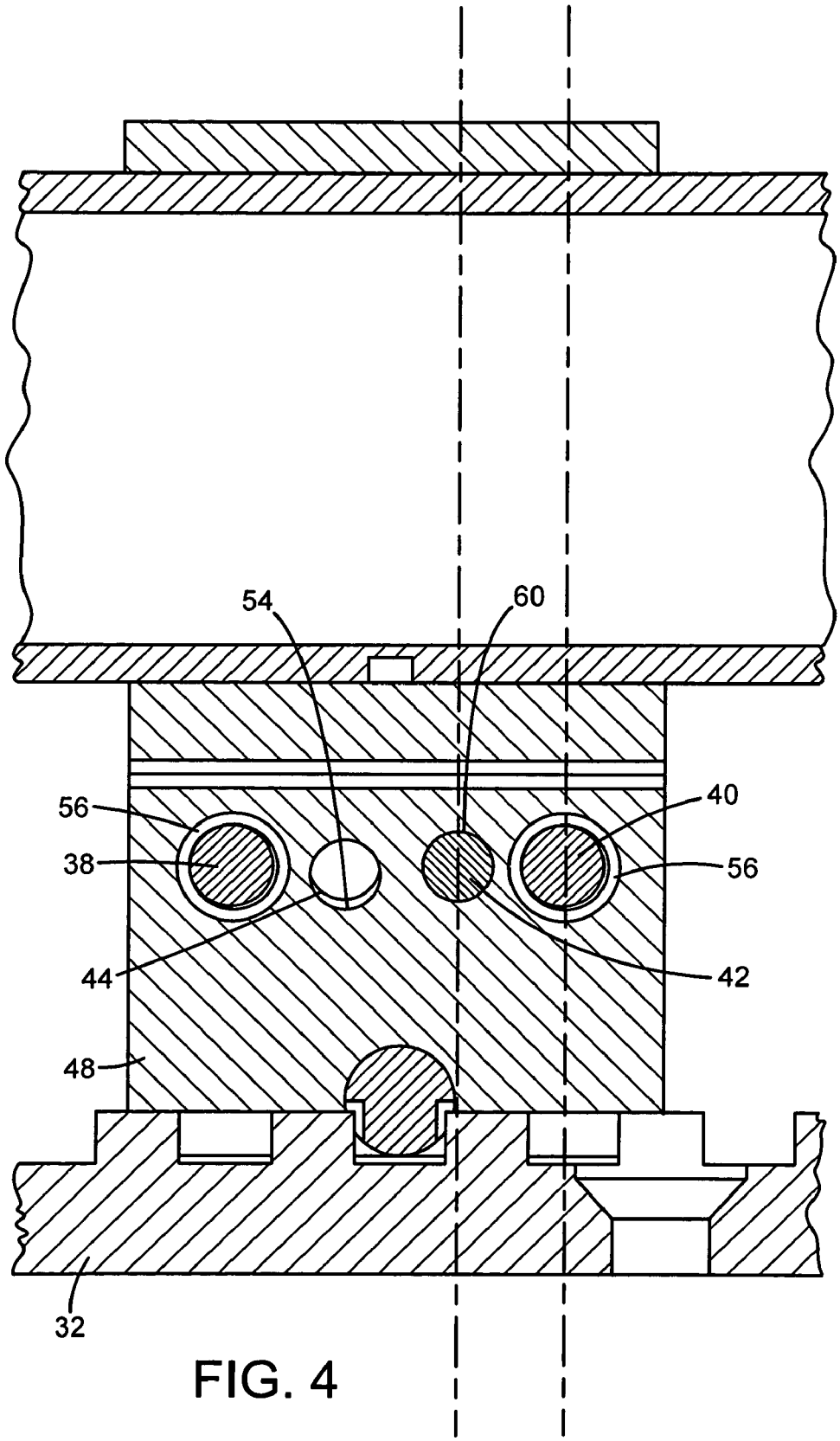
FIG. 4 is an enlarged side sectional view of the current embodiment of the rear mount of the present invention.
Figure 7:
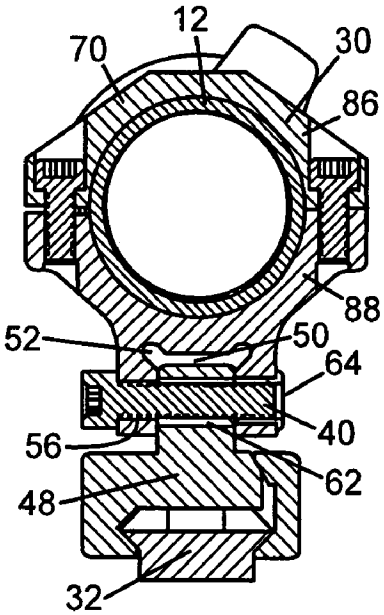
FIG. 7 is a rear sectional view of the current embodiment of the rear mount of the present invention facing towards the scope's rear end.
Figure 6:
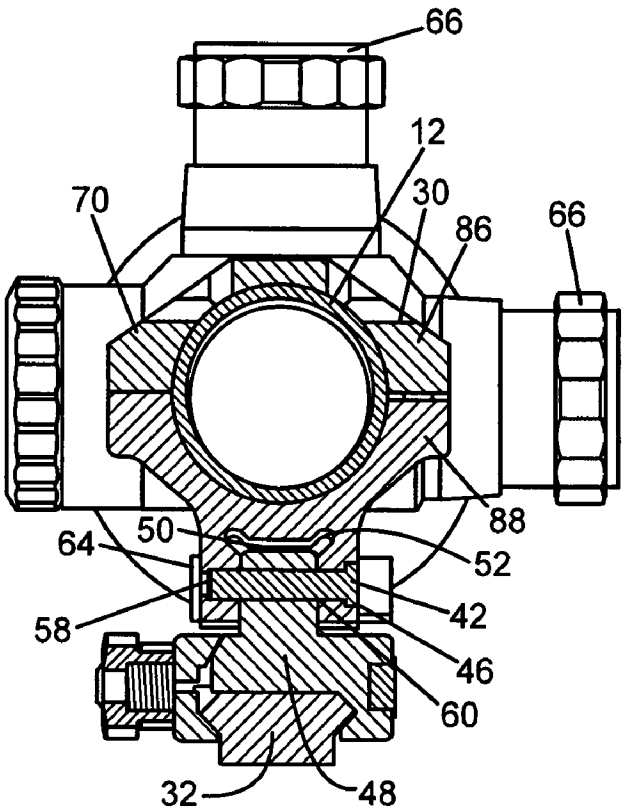
FIG. 6 is a rear sectional view of the current embodiment of the rear mount of the present invention facing towards the scope's front end.

FIGS. 4, 6, and 7 illustrate the rear mount 30 of the present invention in greater detail. More particularly, the fixed vertical positions in the rear mount 30 are established by the first set pin hole 44, second set pin hole 46, third set pin hole 54, and fourth set pin hole 60 as discussed above. Access holes 58 have a smaller diameter than the rear set pin 42, providing the effect of a blind hole, so that the pins can't come out that side. This feature also enables and requires a user to a use a pin punch that is smaller in diameter than the pin bore so as to not let the punch damage the bore. But only a shoulder is provided to prevent the pin from being excessively inserted. The central access holes enable a sufficiently rigid object like a pin punch having a diameter smaller than the access holes 58 to be used to back out rear set pin 42 from the set pin holes in which it is removably installed. The rear set pin 42 has a flanged head to further facilitate the removal of the rear set pin 42 from the set pin holes and to ensure a consistent insertion depth.

Depending upon the selected position of rear set pin 42, the head of either the first rear mount screw 38 or the second rear mount screw 40 partially covers the flanged head of rear set pin 42 to removably secure the rear set pin 42 in place. The size of the access holes 58 and the shape of the rear set pin 42 prevent the rear set pin 42 from being inserted through the access holes 58, which would undesirably prevent the head of one of the rear mount screws from releasably securing the rear set pin 42 in position.

Both the first rear mount screw 38 and the second rear mount screw 40 have threaded inserts 64 mounted to the lower ring portion wings, and threadedly engaged by the screw, while the screw's opposing end terminates in a head with a hexagonal socket adapted to receive a hex key wrench. The rear mount 30's tongue screw holes 62 are sufficiently oversized compared to the rear mount screws that rear mount 30's tongue 48 is free to move within its tongue slot 50, even when the rear mount screws are present, provided the rear mount screws are not tightened sufficiently to produce a clamping action. Relief cuts 52 in the tongue slots 50 enable the wings that form the sides of tongue slots 50 to flex slightly to promote solid friction contact with their respective tongues 48 through a clamping effect created between the mount screws' heads and the end caps when the mount screws are tightened. By firmly frictionally engaging the sides of the tongue slot 50 with the tongue 48, recoil stresses do not bear on the rear set pin 42, which prevents potential stretching of the set pin holes. This is important because any stretching would cause the selected depression angle to vary or otherwise become imprecise. The relief cuts further avoid debris collecting in corners from preventing the tongue from inserting to a desired depth.

A first fixed vertical position of the rear mount is set by inserting rear set pin 42 through second set pin hole 46 and fourth set pin hole 60 when they are coaxially aligned. A second fixed vertical position is set by inserting rear set pin 42 through first set pin hole 44 and third set pin hole 54 when they are coaxially aligned. The two sets of set pin holes are vertically offset from one another. By altering the vertical position of the rear scope ring 70 by changing the position of the rear set pin 42 and pivoting the front scope ring 68 about front pivot pin 34, the angle of the optical axis 20 of the body 12 with respect to the barrel bore axis 76 of the attached firearm 74 is changed. This enables a user to change the initial starting point of the range of the internal optical adjustments controlled by adjustment knobs 66 to enable accurate shots at both long and short distances.

Figure 5:
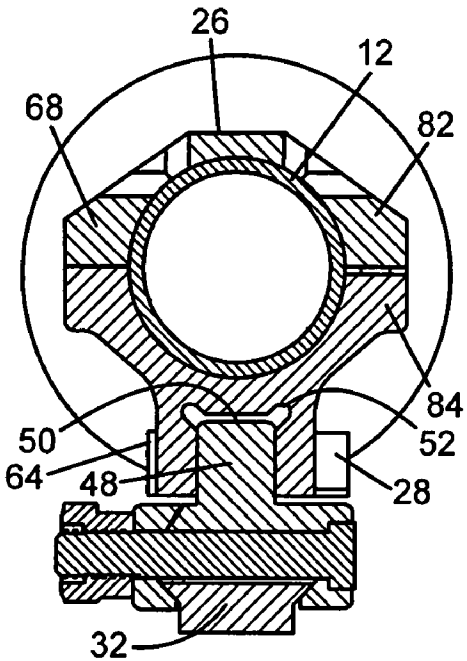
FIG. 5 is a front sectional view of the current embodiment of the front mount of the present invention.

FIG. 5 illustrates the front mount 26 of the present invention 10. More particularly, the front pivot function is provided by a front pivot pin 34, which is inserted into a front pivot pin hole 72 in front mount 26. One end of a first front mount screw 28 partially covers one end of the front pivot pin 34 to secure the front pivot pin 34 within the front pivot pin hole 72. Both the first front mount screw 28 and the second front mount screw 36 have threaded inserts 64 threadedly attached to one end, while their opposing end terminates in a head with a Torx® socket adapted to receive a Torx® key wrench. The front mount 26's tongue screw holes 62 are sufficiently oversized compared to the front mount screws that front mount 26's tongue 48 is free to move within its tongue slot 50, even when the front mount screws are present, provided that the front mount screws are not tightened sufficiently to produce a clamping action. Relief cuts 52 in the tongue slots 50 enable the sides of tongue slots 50 to flex slightly to promote solid friction contact with their respective tongues 48 through a clamping effect created between the mount screws' heads and the end caps when the mount screws are tightened. By firmly frictionally engaging the sides of the tongue slot 50 with the tongue 48, recoil stresses do not bear significantly on the front pivot pin 34, which prevents potential stretching of the front pivot pin hole 72.

To change the angle of the scope's optical axis 20 with respect to the barrel bore axis 76, first front mount screw 28 and second front mount screw 36 must be loosened within their mount screw holes 56. This action permits the front mount 26's tongue 48 to slide within its tongue slot 50 so the lower ring portion 84 can pivot about front pivot pin 34. Subsequently, first rear mount screw 38 and second rear mount screw 40 must be removed from their mount screw holes 56 to fully expose rear set pin 42 and the set pin holes. Rear set pin 42 is then removed from the set of set pin holes in which it is initially installed by backing it out using a suitable object inserted into the appropriate access hole. Then, the rear mount 30's tongue 48 is slid within its tongue slot 50 to coaxially align the other two set pin holes, and then rear set pin 42 has one end removably inserted through the newly aligned set pin holes. Subsequently, first rear mount screw 38 and second rear mount screw 40 are replaced in their mount screw holes 56 to firmly frictionally engage the sides of the rear mount 30's tongue slot 50 with its tongue 48. Finally, first front mount screw 28 and second front mount screw 36 are tightened within their mount screw holes 56 to firmly frictionally engage the sides of the front mount 30's tongue slot 50 with its tongue 48.

While current embodiments of the adjustable rifle telescope system with multiple fixed angle mount setpoints have been described in detail, it should be apparent that modifications and variations thereto are possible, all of which fall within the true spirit and scope of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

For example, there could be a single mount having both a pivoting portion and multiple fixed angle mount setpoints instead of separate front and rear mounts. The single mount might include two rings, or another rail on which rings or a scope is mounted. Furthermore, instead of scope rings with a removable scope, the scope could be all one piece, which directly mounts to such a multi-angle rail that pivots at one end and has two elevation alignments at the other end.

And although enabling accurate long-distance shooting where significant elevation compensation is required has been described, it should be appreciated that the adjustable rifle telescope system with multiple fixed angle mount setpoints herein described is also suitable for use as a spotter scope for a higher-powered telescope. Furthermore, an additional rail, which could be angleable, could be placed between the mounts and the rail directly connected to the firearm. In addition, additional fixed angle mount setpoints could be included in the rear mount. Finally, settings in addition to or instead of the 15 MOA and 40 MOA settings for the rear set pin could be provided. There is no need to limit the number of angle options to two.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable mounting system for mounting a sighting facility defining an optical axis to a firearm defining a barrel bore axis, the mounting system comprising:

a base portion;

the base portion including a mounting facility operable for secure connection to a firearm;

a sight support portion having a mounting facility for fixedly connecting to the sighting facility;

the sight support portion operably connected to the base portion;

the sight support portion having at least two different discrete settings, each setting providing a different angle between the optical axis and the barrel bore axis;

means for securing a selected setting to prevent inadvertent adjustment; and a fastener operable to secure the sight support portion to the base portion in a fixed relation regardless of which discrete setting is selected, such that the sighting facility is maintained in a fixed position relative to the firearm associated with the selected discrete setting when the fastener is secured.

2. The adjustable mounting system as defined in claim 1, wherein each setting is a fixed setting, such that adjustment of a setting is not possible.

3. The adjustable mounting system as defined in claim 1, wherein the means for securing a selected setting to prevent inadvertent adjustment is a screw head.

4. The adjustable mounting system as defined in claim 1, wherein the base portion is a rail system.

5. The adjustable mounting system as defined in claim 1, wherein the scope support portion comprises a scope ring for receiving a tubular portion of a scope.

6. The adjustable mounting system as defined in claim 1, wherein the sight support portion includes a pair of spaced-apart elements.

7. The adjustable mounting system as defined in claim 6, wherein each of the elements is a ring configured to receive a rifle scope.

8. The adjustable mounting system as defined in claim 6, wherein one of the elements is pivotally attached to the base portion.

9. The adjustable mounting system as defined in claim 6, wherein one of the elements has at least two positions of elevation away from the base portion.

10. The adjustable mounting system as defined in claim 1, wherein at least a portion of the sign support portion is pivotally attached to the base portion.

11. An adjustable mounting system for mounting a sighting facility defining an optical axis to a firearm defining a barrel bore axis, the mounting system comprising:

a base portion;

the base portion including a mounting facility operable for secure connection to a firearm;

a sight support portion operably connected to the base portion for rigidly supporting a scope tube containing additional fine adjustment facilities;

the sight support portion having at least two different discrete settings, each setting providing a different elevation angle between the optical axis and the barrel bore axis, and wherein the sight support portion maintains the scope tube in a fixed position relative to the firearm that is associated with a selected discrete setting; and wherein a fastener must be removed to change from one setting to another, and wherein the presence of the fastener ensures the setting is not forcibly changed.

12. The adjustable mounting system as defined in claim 11 wherein the fastener is a pin.

13. The adjustable mounting system as defined in claim 11, wherein the scope support portion comprises a scope ring for receiving a tubular portion of the scope tube.

14. The adjustable mounting system as defined in claim 11, wherein the sight support portion includes a pair of spaced-apart elements.

15. The adjustable mounting system as defined in claim 14, wherein each of the elements is a ring configured to receive a rifle scope.

16. The adjustable mounting system as defined in claim 14, wherein one of the elements is pivotally attached to the base portion.

17. An adjustable mounting system for mounting a sighting facility defining an optical axis to a firearm defining a barrel bore axis, the mounting system comprising a base portion;

the base portion including a mounting facility operable for secure connection to a firearm;

a sight support portion having a mounting facility for fixedly connecting to the sighting facility;

the sight support portion operably connected to the base portion;

the sight support portion having at least two different discrete settings, each setting providing a different angle between the optical axis and the barrel bore axis;

a fastener operable to secure the sight support portion to the base portion in a fixed relation regardless of which discrete setting is selected, such that the sighting facility is maintained in a fixed position relative to the firearm associated with the selected discrete setting when the fastener is secured; and wherein the base portion defines at least two alignment holes, and the sight support portion defines at least two alignment holes, and wherein the position of the system is established by aligning a selected hole of the base with a selected hole of the sight support portion.

18. The adjustable mounting system as defined in claim 17, including a pin closely received by the selected holes.

19. The adjustable mounting system as defined in claim 17, wherein the base portion is a rail system.

20. The adjustable mounting system as defined in claim 17, wherein the scope support portion comprises a scope ring for receiving a tubular portion of a scope.

* * * * *